US007296437B2

(12) United States Patent
Garnier et al.

(10) Patent No.: US 7,296,437 B2
(45) Date of Patent: Nov. 20, 2007

(54) PROCESS FOR SEPARATING AIR BY CRYOGENIC DISTILLATION AND INSTALLATION FOR IMPLEMENTING THIS PROCESS

(75) Inventors: Emmanuel Garnier, Paris (FR); Daniel Gourdain, Lagny sur Marne (FR); Frederic Judas, Chatenay-Malabry (FR); Patrick Le Bot, Vincennes (FR); Frederic Staine, Le Plessis Trevise (FR)

(73) Assignee: L'Air Liquide, Societe Anonyme A Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 426 days.

(21) Appl. No.: 11/066,060

(22) Filed: Feb. 25, 2005

(65) Prior Publication Data

US 2005/0193765 A1 Sep. 8, 2005

(51) Int. Cl.
*F25J 3/00* (2006.01)

(52) U.S. Cl. ..... 62/643; 62/646; 62/903

(58) Field of Classification Search ..... 62/643, 62/646, 903

See application file for complete search history.

(56) References Cited

U.S. PATENT DOCUMENTS 4,375,367 A * 3/1983 Prentice ..... 62/645
5,146,756 A * 9/1992 Lavin ..... 62/646
5,839,296 A * 11/1998 Bonaquist et al. ..... 62/650
5,860,296 A * 1/1999 Mostello ..... 62/643
6,128,921 A * 10/2000 Guillard et al. ..... 62/643
6,339,938 B1 * 1/2002 De Bussy et al. ..... 62/643
6,351,969 B1 * 3/2002 Arman et al. ..... 62/643
6,484,534 B2 * 11/2002 Tranier ..... 62/646
6,499,312 B1 * 12/2002 Bergman et al. ..... 62/643
7,219,514 B2 * 5/2007 Garnier et al. ..... 62/643

OTHER PUBLICATIONS

Alpema, "*The Standards of the Brazed Aluminium Plate-Fin Heat Exchanger Manufacturers' Association*", Second Edition, 2000.

* cited by examiner

*Primary Examiner*—William C Doerrler
(74) *Attorney, Agent, or Firm*—Elwood Haynes

(57) ABSTRACT

A process and an apparatus for separating air by cryogenic distillation. The apparatus has a medium pressure column thermally coupled to a low pressure column. Compressed and purified air is cooled to cryogenic temperature in an exchanger, and sent at least partly to the medium pressure column. Streams enriched in oxygen and nitrogen are sent from the medium pressure column to the low pressure column and, streams enriched in nitrogen and oxygen are removed from the low pressure.

16 Claims, 2 Drawing Sheets

PROCESS FOR SEPARATING AIR BY CRYOGENIC DISTILLATION AND INSTALLATION FOR IMPLEMENTING THIS PROCESS

BACKGROUND

It is well known to use, for producing oxygen with low energy, a double air separation column which is applied, in particular, on the one hand, so as to minimize the delivery pressure of the air compressor, by reducing the head losses in the exchanger and reducing the temperature difference at the main vaporizer, and, on the other hand, to maximize the oxygen extraction efficiency, by reducing the temperature difference in the exchanger, by choosing a high number of theoretical distillation trays and by installing a sufficient number of sections of structured packings or trays.

Thus, low-pressure columns have four sections of structured packings or trays, including two sections between the bottom of the low-pressure column and an intake for rich liquid, this being an oxygen-enriched liquid taken from the bottom of the medium-pressure column. These two sections are necessary for providing high-performance distillation in the bottom of the low-pressure column. Thus also, the medium-pressure columns have four sections of structured packings or of trays, including two sections between the liquid air intake and the point of withdrawal of lean liquid.

The exchanger of an air separation unit is normally composed of an exchange body assembly or of several body subassemblies.

An exchange body assembly comprises an even number of exchange bodies, each of which is fed with the same fluids to be cooled and the same fluids to be warmed. The fluid feed is made via a common header line for each different fluid (different composition and/or pressure), as illustrated in FIGS. 1-3 of "*The Standards of the Brazed Aluminum Plate-Fin Heat Exchanger Manufacturers ' Association*", 2nd Edition, 2000.

Since the maximum number of bodies that can be fed via a single header line is 12 (i.e. 6 pairs of exchange bodies), it is often necessary for large-capacity units to use several exchange body subassemblies, each subassembly comprising an even number of exchange bodies and the bodies of each subassembly being fed via a common header line for each different fluid. Thus, an exchanger composed of two exchange body subassemblies will comprise a first delivery line sending air to be cooled to the first subassembly and a second delivery line sending air to be cooled to the second subassembly. Likewise, it will comprise a first header line recovering the cooled air from the first subassembly and a second header line recovering the cooled air from the second subassembly.

The purified and compressed air sent to the columns cools in an exchanger comprising a single body assembly which would normally have a volume of more than 200 $m^3$, and therefore with a ratio of the total air volume sent to the exchanger to the volume of the exchanger that would be approximately 2,000 $Nm^3/h/m^3$ in the case of the example described below.

The refrigeration required for the distillation is frequently provided by an air stream sent to a blowing turbine that feeds the low-pressure column and/or an air stream sent to a Claude turbine. The ratio of the quantity of air sent to the exchanger to the volume sent to the blowing turbine would normally be between 5/1 and 15/1 in the case of the example described below.

In certain cases when energy is not expensive, or even free, it is profitable to reduce expenditure on equipment, while increasing energy requirements.

In a process for separating air by cryogenic distillation known from WO 03/033978 using an apparatus comprising a medium-pressure column and a low-pressure column that are thermally coupled, a quantity of compressed and purified air V is cooled in an exchange line down to a cryogenic temperature and is sent at least partly to the medium-pressure column, oxygen-enriched and nitrogen-enriched streams are sent from the medium-pressure column to the low-pressure column and nitrogen-enriched and oxygen-enriched streams are withdrawn from the low-pressure column, the medium-pressure column operating between 6 and 9 bar absolute and the ratio of the volumetric flow rate of air V entering the exchanger to the total volume of the exchanger being between 3,000 and 6,000 $Nm^3/h/m^3$.

With a ratio of the volumetric flow rate of air V entering the exchanger to the total volume of the exchanger of less than 6,000 $Nm^3/h/m^3$, and by considering an air separation unit having a volumetric flow rate of air of about 570,000 $Nm^3/h$, the total volume of the exchanger is about 110 $m^3$ with an exchanger composed of at least 14 exchange bodies, the maximum volume of an exchange body being about 8 $m^3$.

As regards questions about the uniform distribution of the streams between the various exchanger bodies, the prior art dictates two exchange body subassemblies, a first subassembly of which comprising 8 exchanger bodies grouped together in four pairs and a second subassembly of which comprising six exchanger bodies grouped together in three pairs. It is not conceivable to install a single assembly of 14 exchanger bodies (the distribution of the streams will not be uniform because of the long distances that exist in this case between the bodies, and the performance of the air separation unit will be affected).

With a ratio of the volumetric flow rate of air V entering the exchanger to the total volume of the exchanger of about 7,000 $Nm^3/h/m^3$, and considering an air separation unit having a volumetric flow rate of air of about 570,000 $Nm^3/h$, the total volume of the exchanger is about 80 $m^3$ with a single exchange body assembly that is composed of 10 exchanger bodies, the maximum volume of an exchange body being about 8 $m^3$. In this case, the uniform distribution of the streams between the various exchanger bodies is achieved favorably with a single exchange body assembly, so that there is only a single common delivery or header line for each fluid fed into or coming from the 10 bodies.

Likewise, for an air separation unit having a volumetric flow rate of air of about 475,000 $Nm^3/h$, owing to the low cost of the energy or to the amount of energy available, the investment cost will be minimized by installing an exchange line composed of a single assembly of exchanger bodies (8 bodies) and the volume of which will correspond to a ratio of the volumetric flow rate of air V entering the exchanger to the total volume of the exchanger of about 7,400 $Nm^3/h/m^3$.

Moreover, increasing the ratio of the volumetric flow rate of air V entering the exchanger to the total volume of the exchanger ought to result, according to the prior art, in an increase in the head losses in the exchanger for all the streams of the exchanger (waste nitrogen stream, air streams, oxygen stream, etc.), especially because of the increase in the flow rate due to the reduction in flow area.

However, for ratios of the volumetric flow rate of air V entering the exchanger to the total volume of the exchanger greater than 6,000 $Nm^3/h/m^3$, the head losses on the oxygen stream will not be increased but will be constant at a limiting value corresponding to a usually acceptable design with regard to an oxygen stream. To keep the oxygen stream rate constant while reducing the volume of the exchanger is generally possible only by keeping a constant flow area for each body of the exchanger, and therefore keeping the total number of passages of the exchanger with regard to the oxygen stream constant, which results in an increase in the number of oxygen passages in each body of the exchanger (since the number of bodies of the exchanger is reduced). Consequently, the head losses on the other streams will therefore increase more than what is obtained by the simple ratio of the number of bodies.

However, in particular in the case of liquid oxygen passages in which the liquid has to vaporize, a variable flow area, or an increase in the flow area, may be provided.

Typically, the head losses with regard to the oxygen stream will not exceed 400 mbar and the flow area with regard to the oxygen stream will not exceed 20 to 25 $Nm^3/h/cm^2$. The flow area corresponds either to the constant cross section or to the cross section at the point where the liquid vaporizes, for the case of a liquid stream.

The oxygen stream comprises at least 30 mol % oxygen, preferably at least 70 mol % oxygen, and even more preferably at least 90 mol % oxygen, and may be in gaseous or liquid form at the inlet of the exchanger.

SUMMARY

It is an object of the present invention to reduce the investment cost of an air separation installation and to increase its energy by reducing the size of the exchangers (and therefore increasing the head losses and the temperature differences in the exchanger, and increasing the temperature difference at the main vaporizer), by reducing the size of the distillation columns (by minimizing the number of theoretical trays and the number of sections of packings or trays).

The quantity of air V sent to the exchanger comprises all the air sent to the distillation unit and the possible streams of air that are expanded and then vented to atmosphere.

A section of structured packings is a section of structured packings between a fluid inlet and the adjacent inlet or outlet.

The structured packings are typically of the cross-corrugated type, but they may have other geometries. They may be perforated and/or partially staggered.

The subject of the present invention is a process for separating air by cryogenic distillation using an apparatus comprising a medium-pressure column and a low-pressure column that are thermally coupled, in which a quantity of compressed and purified air V is cooled in an exchanger down to a cryogenic temperature and is sent at least partly to the medium-pressure column, oxygen-enriched and nitrogen-enriched streams are sent from the medium-pressure column to the low-pressure column and nitrogen-enriched and oxygen-enriched streams are withdrawn from the low-pressure column, characterized in that the ratio of the volumetric flow rate of air V entering the exchanger to the total volume of the exchanger is greater than 3,000 $Nm^3/h/m^3$ and preferably between 3,000 and 10,000 $Nm^3/h/m^3$ and in that the ratio of the oxygen stream leaving the exchanger to the total flow area of the passages of the exchanger that are reserved for this oxygen stream is less than 25 $Nm^3/h/cm^2$.

Preferably, the ratio of the volumetric flow rate of air V entering the exchanger to the total volume of the exchanger is greater than 6,000 $Nm^3/h/m^3$ and preferably between 6,500 and 10,000 $Nm^3/h/m^3$.

According to other optional aspects:

- the ratio of the volumetric flow rate of air V entering the exchanger to the total volume of the exchanger is between 6,500 and 10,000 $Nm^3/h/m^3$;
- the ratio of the volumetric flow rate of air V entering the exchanger to the total volume of the exchanger is between 7,000 and 10,000 $Nm^3/h/m^3$;
- the maximum temperature difference at the cold end of the exchanger is 10° C.;
- the maximum temperature difference at the warm end of the exchanger is 10° C.;
- the maximum temperature difference at the start of liquid oxygen vaporization in the exchanger is 3° C.;
- the maximum temperature difference at the end of liquid oxygen vaporization in the exchanger is 14° C.;
- an oxygen-enriched liquid is sent from the low-pressure column to a sump reboiler where it partially vaporizes by heat exchange with a nitrogen-enriched gas coming from the medium-pressure column, the reboiler having a $\Delta T$ of at least 2.5 K;
- a portion of the compressed and purified air is sent into a blowing turbine, having an inlet temperature of between −50 and −140° C., preferably between −100 and −130° C.;
- the ratio of the quantity of air V to the volume of air sent to the blowing turbine is less than 40 and preferably between 5 and 25;
- at least one liquid stream is withdrawn from a column, optionally pressurized and vaporized in the exchanger;
- the medium-pressure column operates at between 6.5 and 8.5 bar absolute;
- the head losses in the exchanger are greater than 200 mbar for a waste nitrogen stream coming from the low-pressure column;
- the head losses in the exchanger are greater than 250 mbar for the lower-pressure air stream;
- the ratio of the quantity of air V to the volume of air D is between 5/1 and 25/1;
  - i) a liquid-air expansion turbine is fed by all or part of a stream of liquid air output by the exchanger; and/or
  - i) a refrigeration set or chilled water produced by a refrigeration set (which may be the same water circuit as that used for cooling the air at the inlet of the purification unit) cools the air output by an air supercharger and/or the air at the lowest pressure; and/or
  - iii) an increased stream of air is sent to the blowing turbine in such a way that the ratio of the quantity of air V sent to the exchange line to the volume of air D sent to the blowing turbine is less than 10/1;
- the purity of the oxygen is between 30 and 100 mol %, preferably between 95 and 100 mol %;
- the oxygen extraction efficiency is between 85 and 100%.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

The subject of the invention is also an air separation installation for producing air gases using a process described above, comprising the medium-pressure column containing two or three sections of structured packings and/or the low-pressure column containing three sections of structured packings.

Optionally, the installation may include an argon column fed from the low-pressure column. A blowing turbine expands air and sends at least one portion thereof to the low-pressure column of a double column.

Figure 1:
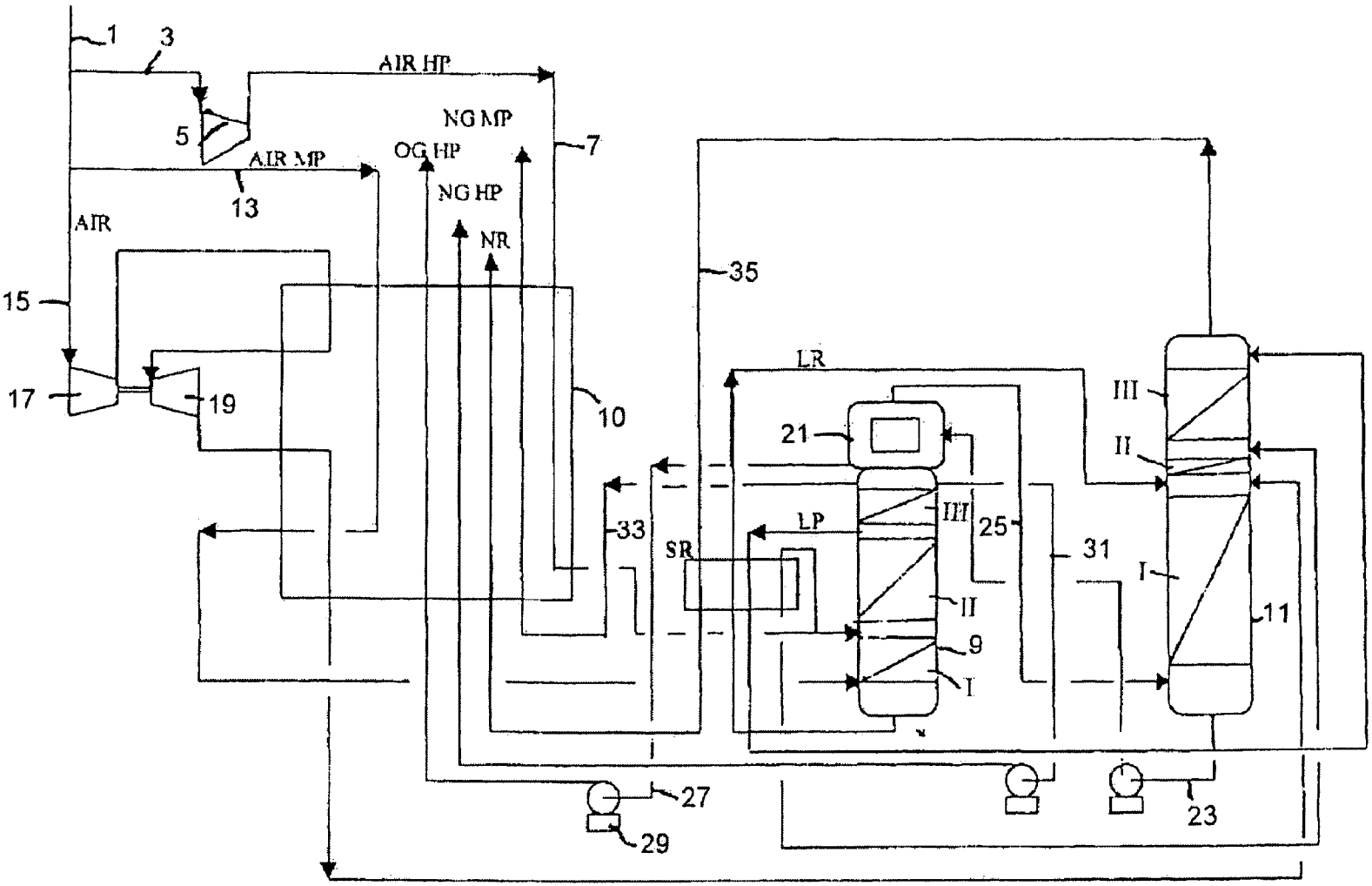
FIG. 1 illustrates a diagram of an installation for implementing the process according to the invention.
Figure 2:
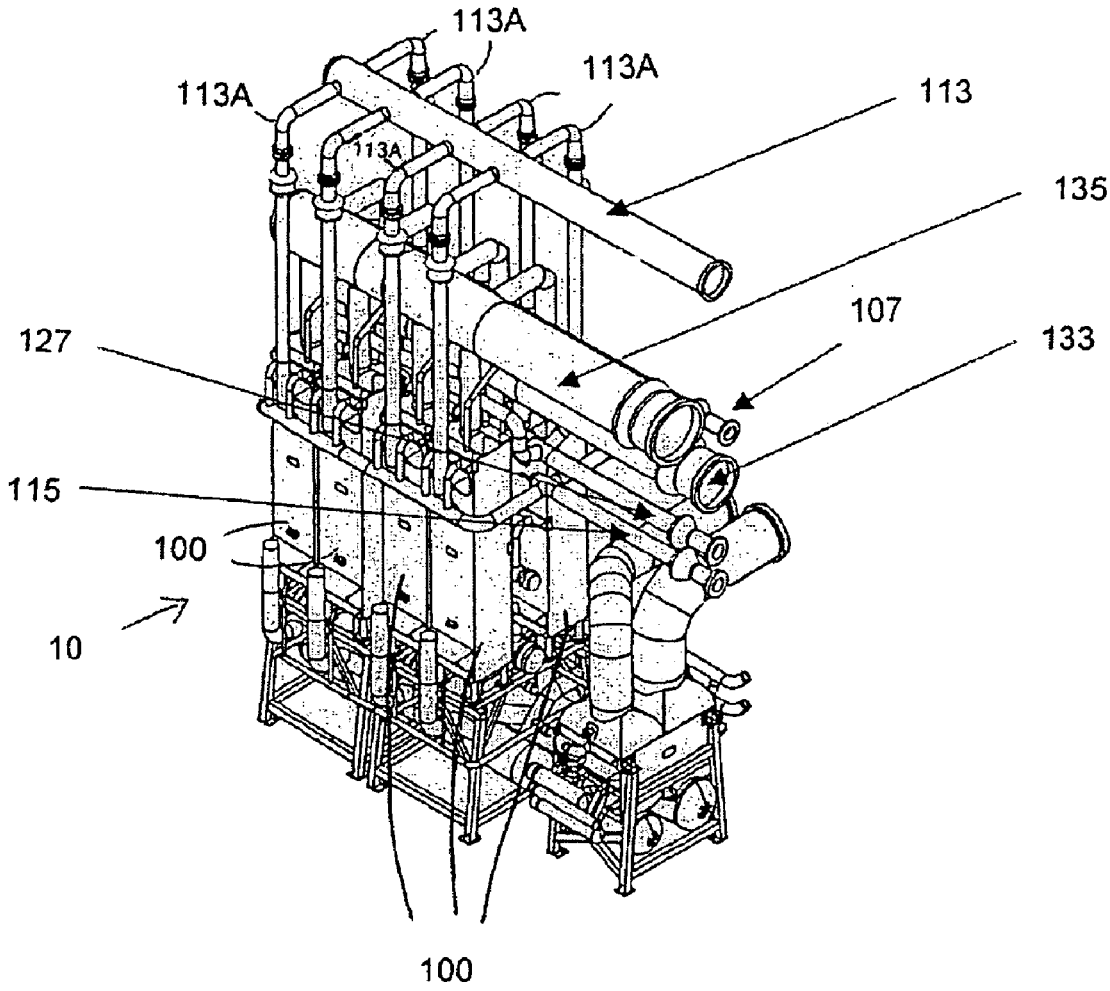
FIG. 2 illustrates is an illustration of an exchanger used in the installation of FIG. 1.

The invention will now be described with reference to the figures, of which FIG. 1 is a diagram of an installation for implementing the process according to the invention and FIG. 2 is an illustration of an exchanger used in the installation of FIG. 1.

In FIG. 1, a 475,000 $Nm^3/h$ stream of air 1 at 7 bar absolute, coming from a purification unit (not illustrated), is divided into three. A first stream 3 is supercharged in the supercharger 5 up to the pressure required to vaporize the liquid oxygen for example. The high-pressure air HP AIR 7 is sent to the exchanger 10 but does not reach the cold end, being cooled down to −160° C., expanded, liquefied and sent to the two columns 9 and 11, namely the medium-pressure column and the low-pressure column, respectively, of an air separation double column.

A second, non-supercharged, stream MP AIR 13 is also sent to the exchanger 10, through which it partly flows until reaching −140° C. before being sent to the bottom of the medium-pressure column 9.

A third stream 15 of about 45,000 $Nm^3/h$ is sent to a supercharger 17, partly cooled in the exchanger, and expanded in a blowing turbine 19, with an inlet temperature of −130° C., before being sent to the low-pressure column 11. The ratio of the volume of air sent through the blowing turbine 19 to the quantity of air sent to the exchanger is 10/1.

The head losses in the exchanger 10 are about 300 mbar in the case of the air stream 13 at the lowest pressure and about 250 mbar in the case of the waste nitrogen 35.

The exchanger 10 has a volume of 60 $m^3$, thus the ratio of the volumetric flow rate of air sent to the exchanger 10 (stream 1 or volume V) to the volume of this exchange line 10 (=number of bodies×total width×total stack×total length) is 7,900 $Nm^3/h/m^3$.

The double column is a conventional apparatus except as regards its dimensions and the number of theoretical trays of the columns, since the medium-pressure column contains 40 theoretical trays and the low-pressure column 45 of them, and as regards the temperature difference in the case of the reboiler 21, which is greater than 2.5° C.

Conventionally, oxygen-enriched liquids (rich liquid RL) and nitrogen-enriched liquid (lean liquid LL) are sent from the medium-pressure column to the low-pressure column after subcooling in the exchanger SC and expansion in a valve.

The low-pressure column 11 contains three sections of structured packings, comprising a sump section I between the bottom of the column and the rich liquid intake (which is conjoint with the blown air intake), a section II between the rich liquid intake and the liquid air intake and a section III between the liquid air intake and the lean liquid intake.

The medium-pressure column 9 contains three structured packings, comprising a sump section I between the bottom of the column and the liquid air intake, a section II between the liquid air intake and the lean liquid outlet LL and a section III between the lean liquid outlet LL and the medium-pressure nitrogen outlet 31. Of course, if there is no withdrawal of liquid nitrogen or gaseous nitrogen, the medium-pressure column contains only two sections, section III being omitted.

The sump reboiler 21 of the low-pressure column 11 is in fact incorporated with the medium-pressure column 9 and is warmed by a stream of medium-pressure nitrogen of this column 9. A stream of liquid oxygen 23 coming from the bottom of the low-pressure column 11 is pumped in order to overcome the hydrostatic head and arrives in the reboiler 21 where it partially vaporizes, a gas stream 25 being sent back to the low-pressure column below the exchange means I and a liquid stream 27 being sent to the pump 29, where it is pressurized up to its use pressure. The pumped stream 27 vaporizes in the exchanger 10.

A stream of liquid nitrogen 31 is withdrawn as top product from the medium-pressure column 9 above section III, pumped and also vaporizes in the exchanger 10.

The pressure of the liquid nitrogen and the pressure of the liquid oxygen may take any value, provided that the exchanger 10 is designed according to the maximum pressure of the air required for vaporization.

It will be understood that the invention also applies to the case in which a single stream of liquid vaporizes in the exchanger 10, or no liquid withdrawn from a column vaporizes in the installation.

Instead of vaporizing against air, the stream or streams of liquid may vaporize against a stream of cycle nitrogen.

Alternatively, the liquid stream or streams may vaporize in a dedicated exchanger serving only to vaporize the liquid stream or streams against a stream of air or a stream of cycle nitrogen.

The process may also produce liquid oxygen and/or liquid nitrogen and/or liquid argon as final product(s).

Gaseous nitrogen 33, 35 may be withdrawn from the medium-pressure column 9 and/or from the low-pressure column 11.

The gaseous nitrogen 35 warms in the subcooler SC.

Alternatively or in addition, a stream of gaseous oxygen (not illustrated) may be withdrawn as final product from the low-pressure column 11. Optionally, this stream may be pressurized in a compressor.

A stream of medium-pressure gaseous nitrogen MP NG 33 and a stream of low-pressure waste nitrogen 35 are warmed in the exchanger 10.

The stream WN may serve to regenerate the air purification system in a known manner and/or may be sent to a gas turbine.

A process as described is used to produce 99.5 mol % pure oxygen HP OG with a yield of more than 95%. This oxygen serves typically in a gasifier supplied with a fuel such as natural gas.

In the installation, the low-pressure column 11 may be alongside the medium-pressure column 9, as in the example, or else above the latter.

To produce a stream of liquid oxygen and/or liquid nitrogen and/or liquid argon and/or to reduce the pressure levels, especially the pressure of the HP AIR 7, the refrigeration required may be provided by using:

i) a liquid-air expansion turbine fed completely or partly with the liquid air stream HP 7 output by the exchanger (10); and/or ii) a refrigeration set or chilled water produced by a refrigeration set (which come from the same water circuit as that used for cooling the air at the inlet of the purification unit) in order to cool air output by the air supercharger 5 and/or the air output by the supercharger 17 and/or the MP 13; and/or iii) by sending an increased stream of air to the blowing turbine 19 in such a way that the ratio of the quantity of air V sent to the exchanger to the volume of air D sent to the blowing turbine is less than 10/1.

These means for generating refrigeration may also be employed in the case in which no liquid is produced as final product.

The superchargers 5, 17 and/or the main compressor (not illustrated) may be driven by an electric motor and/or by a hydraulic motor and/or by a steam turbine and/or by a gas turbine.

The turbine 19 may have a dedicated supercharger or a generator.

The installation may also include conventional components well known to those skilled in the art, such as a Claude turbine, a hydraulic. turbine, a medium-pressure or low-pressure nitrogen turbine, for refrigeration top-up by tippling, one or more argon production columns, a mixing column fed with air and oxygen from the low-pressure column, a column operating at an intermediate pressure, for example one fed with the rich liquid and/or with air, a double-reboiler or triple-reboiler low-pressure column, etc.

FIG. 2 shows an exchanger 10 suitable for being used in the process of FIG. 1.

The exchanger 10 has a volume of 60 $m^3$, thus the ratio of the volumetric flow rate of air sent to the exchanger 10 (stream 1 or stream V) to the volume of this exchange line 10 (=number of bodies×total width×total stack×total length) is 7,900 $Nm^3/h/m^3$.

Given that the maximum volume of a body is about 8 $m^3$, the number of bodies 100 is 8, so as to have an even number of bodies, four bodies 100 of which are placed on each side of a central line.

The medium-pressure air 13 is sent to a delivery line 113 and then to 8 pipes 113A, each of which feeds a body 100. The cooled medium-pressure air is then sent to a header line (not illustrated) and then to the medium-pressure column. High-pressure air 15 is sent to a delivery line 115 and then to two pipes, each of which feeds four bodies 100. High-pressure air 7 is sent to a delivery line 107 and then to two pipes, each of which feeds four bodies 100.

Warmed waste nitrogen 35 is collected from the eight bodies 100 in a header line 135.

Each body comprises passages fed via a pumped-liquid-oxygen delivery line having a diameter of at least 25 cm. The total flow area of all the passages reserved for the oxygen in the 8 bodies 100 is less than 25 $Nm^3/h/cm^2$, in the vicinity of 20 $Nm^3/h/cm^2$.

The gaseous oxygen produced by vaporization is sent to a header line 127, the diameter of which is at least 25 cm, preferably about 30 cm.

Low-pressure nitrogen 33 is sent to the header line 133.

What is claimed is:

1. A method which may be used for separating air by cryogenic distillation with a thermally coupled medium pressure column and low pressure column, said method comprising:

a) cooling compressed and purified air to a cryogenic temperature in an exchanger, wherein the ratio of the volumetric flow rate of said air entering said exchanger to the total volume of said exchanger is greater than about 3,000 $Nm^3/h/m^3$;

b) sending at least part of said air to said medium pressure column;

c) sending at least one oxygen enriched stream, and at least one nitrogen enriched stream from said medium pressure column to said low pressure column;

d) withdrawing at least one nitrogen enriched stream and at least one oxygen enriched stream from said low pressure column;

e) sending said withdrawn streams to said exchanger; and f) withdrawing at least one oxygen stream from said exchanger, wherein the ratio of the volumetric flow rate of said oxygen stream withdrawn from said exchanger to the total flow area of the exchanger passages through which said stream is withdrawn is less than about 25 $Nm^3/h/cm^2$.

2. The method of claim 1, wherein said ratio of the volumetric flow rate of said air entering said exchanger to the total volume of said exchanger is between about 3,000 $Nm^3/h/m^3$ and about 10,000 $Nm^3/h/m^3$.

3. The method of claim 1, further comprising:

a) sending an oxygen enriched liquid from said low pressure column to a sump reboiler, wherein said reboiler has a $\Delta T$ of at least about 2.5° C.; and b) partially vaporizing said oxygen enriched liquid by heat transfer with a nitrogen enriched gas from said medium pressure column.

4. The method of claim 1, wherein said exchanger comprises:

a) a single assembly comprising less than about twelve exchange bodies, wherein each said body is fed with the same fluid; and b) a delivery line common to all said exchange bodies, wherein said same fluid is delivered to said bodies through said delivery line.

5. The method of claim 1, further comprising performing, in said exchanger, an operation on at least one liquid stream withdrawn from said low pressure column, wherein said operation comprises at least one member selected from the group consisting of:

a) pressurizing; and b) vaporizing.

6. The method of claim 4, wherein said operation is performed in a second exchanger.

7. The method of claim 1, further comprising performing, in said exchanger, an operation on at least one liquid stream withdrawn from said medium pressure column, wherein said operation comprises at least one member selected from the group consisting of:

a) pressurizing; and b) vaporizing.

8. The method of claim 7, wherein said operation is performed in a second exchanger.

9. The method of claim 1, wherein said medium pressure column operates in a range between about 5 bar absolute and about 15 bar absolute.

10. The method of claim 5, wherein said range is between about 6.5 bar absolute and about 8.5 bar absolute.

11. The method of claim 1, wherein said nitrogen stream from said low pressure column has a head loss, in said exchanger, of at least about 200 mbar.

12. The method of claim 1, further comprising a lower pressure air stream with a head loss, in said exchanger, of at least about 250 mbar.

13. The method of claim 1, further comprising an additional process, wherein said additional process comprises at least one member selected from the group consisting of:

a) feeding at least part of a stream of liquid air from said exchanger to a liquid-air expansion turbine;

b) cooling an airstream with a cooler, wherein:

1) said airstream comprises at least one member selected from the group consisting of:

i) air output by an air supercharger; and ii) the lowest pressure air available;

2) said cooler comprises at least one member selected from the group consisting of:

i) a refrigeration set; and ii) chilled water; and c) sending an increased stream of air to a blowing turbine, wherein the ratio of the quantity of said air entering said exchanger to the volume of said increased stream of air is less than about 10 to 1.

14. The method of claim 1, wherein the purity of said withdrawn oxygen stream is between about 85 mol % and about 100 mol %.

15. The method of claim 10, wherein said purity is between about 95 mol % and about 100 mol %.

16. The method of claim 1, wherein the efficiency of extracting said oxygen stream is between about 85% and about 100%.

* * * * *